United States Patent [19]

Eberle

[11] 4,159,055

[45] Jun. 26, 1979

[54] GATHERING HEAD

[75] Inventor: William R. Eberle, Westerville, Ohio

[73] Assignee: Dresser Industries, Inc., Dallas, Tex.

[21] Appl. No.: 755,289

[22] Filed: Dec. 29, 1976

[51] Int. Cl.[2] ..... B65G 65/02

[52] U.S. Cl. ..... 198/512; 37/43 A; 37/65; 198/515; 198/518; 299/56; 299/67

[58] Field of Search ..... 198/512, 514, 515, 518, 198/608, 624; 299/43, 44, 45, 46, 56, 64, 65, 67, 68; 37/43 A, 65

[56] References Cited

U.S. PATENT DOCUMENTS

| | | | |
|---|---|---|---|
| 1,256,642 | 2/1918 | Barber | 198/307 |
| 1,752,714 | 4/1930 | Wilcox | 198/515 |
| 1,796,943 | 3/1931 | Pratt | 198/515 |
| 2,606,416 | 8/1952 | Bruner | 55/106 |
| 3,417,851 | 12/1968 | Gonski et al. | 198/308 |
| 3,620,345 | 11/1971 | Gonski | 198/512 |
| 3,817,579 | 6/1974 | Delli-Gatti | 198/515 X |
| 4,056,189 | 11/1977 | Freed | 198/514 |

FOREIGN PATENT DOCUMENTS 1086628 8/1960 Fed. Rep. of Germany.

*Primary Examiner*—John J. Love
*Assistant Examiner*—Douglas D. Watts
*Attorney, Agent, or Firm*—Paul E. Krieger

[57] ABSTRACT

An improved rotating disc-type gathering head suited for use with underground mining machines includes at least two gathering discs mounted for rotation on an inclined apron in positive engaging relationship at their point of tangency. One of the discs is rotatably driven, preferably by means mounted above the apron. The second disc is rotated in the opposite direction by the first disc to provide the desired flow of mined material. In the preferred embodiment the discs have peripherally disposed intermeshing gear teeth, and the drive means comprises a pinion gear in peripheral engagement with the first disc. Additional gathering discs can be added without complicating the simple mechanical drive system below the apron.

16 Claims, 8 Drawing Figures

GATHERING HEAD

The present invention relates to an improved gathering or loading device suited for use with mining machinery, and more particularly to a disc-type gathering head especially suited for use with a rotary drum-type continuous miner.

Although it will be apparent that the invention has a variety of applications wherever loose material is to be gathered or loaded onto a conveyor or the like, it will be described hereinafter in connection with a drum-type underground continuous miner, such as a Jeffrey Heliminer. Such miners, which are sometimes referred to as "fixed head" miners, have been known for several years and presently enjoy widespread use in the mining of coal and other similar materials. Further development of these machines continues with an emphasis on lower machines for use in mining low seam coal.

Briefly, this type of miner comprises a frame mounted for tramming along a mine floor and for sumping into the mine face. A rotating drum provided with a pattern of cutting elements is normally supported on a transverse axis from the front of the frame. The cutter is generally adapted to be ranged up and down to cut the full height of the coal seam. The miner further includes a gathering head mounted at the front of the frame and below the cutting head to collect the loosened mine material and move it to a conveyor. The conveyor, which is usually located centrally of the frame, carries the material to the back of the machine where it is transferred to other means for hauling it from the mine. A more detailed description of a typical drum-type miner can be found in U.S. Pat. No. 3,318,638.

Many of these drum-type miners are provided with a gathering head which consists of an inclined apron having a plow-like nose and two orbitally oscillating gathering arms mounted on the apron. These arms oscillate in opposite directions to sweep the mined material toward the center and back of the apron. A typical gathering head of this type is shown in U.S. Pat. No. 3,317,022. Although this type of gathering head has been widely used, it has been handicapped by its bulk and mechanical complexity which causes maintenance problems.

Another type of gathering head which has been more recently developed uses counter-rotating discs mounted on the apron surface. It has the advantage of smoother flow of material thereby increasing the loading rate of a machine. Heretofore, this type of gathering head has had two counter-rotating discs mounted on the apron in recesses such that the upper surfaces of the discs are generally flush with the upper surface of the apron. Two gathering heads of this type are shown in U.S. Pat. Nos. 3,417,851 and 3,817,579. As can be seen from these examples, the discs were independently driven through power transmission means connected to the shaft of each of the discs below the surface of the apron. This drive arrangement was necessarily complex and required such space as to be a limiting factor in reducing the profile of the gathering head and thereby limiting its applicability to low seam miners.

Accordingly, it is the principal object of the present invention to provide an improved disc-type gathering head which is lower in profile, economical to manufacture, mechanically simple so as to require minimal maintenance, and which can gather and convey mined material sufficiently fast so as not to limit the capacity of the mining machine with which it is used.

This objective is accomplished with the present invention in which the counter-rotating discs are adapted to engage each other peripherally at their tangent whereby only one of the discs need be driven by transmission means. The one disc in turn drives the other disc. In a particular embodiment, the periphery of each disc comprises gear teeth which mesh with the correspondingly pitched teeth of the other disc. The first disc is driven by a pinion gear, smaller in diameter than the disc, which is mounted on a higher and remote part of the apron.

This improved gathering head offers several advantages over the prior art gathering heads. Because the discs engage each other, synchronization is insured. The transmission needed to drive the disc is simplified and the profile of the gathering head can be reduced. Furthermore, the invention has demonstrated excellent gathering and loading ability with minimal maintenance.

Having thus briefly described the invention, a more detailed description follows with reference to the attached drawings which form part of this Specification and of which:

Figure 1:
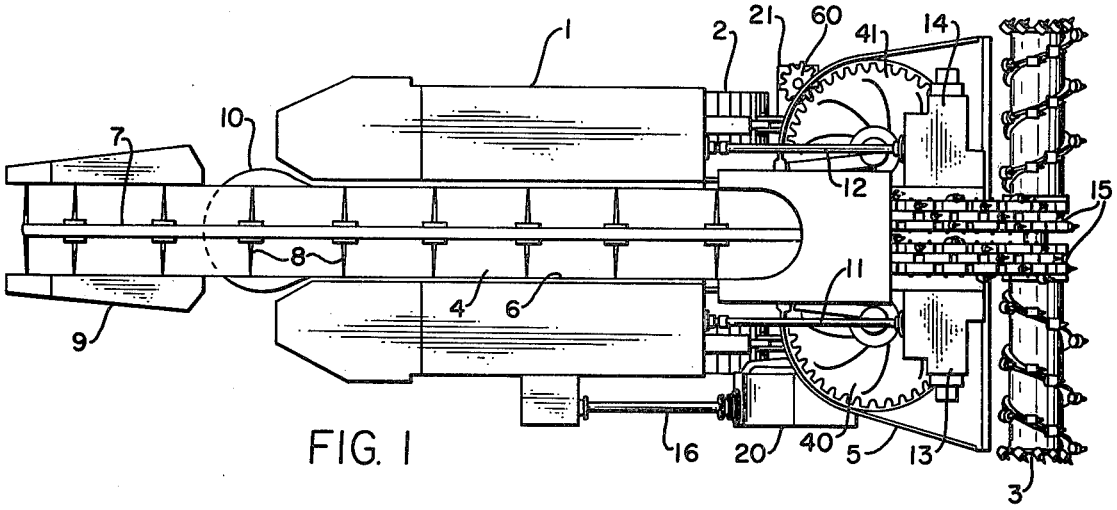
FIG. 1 is a plan view showing a typical drum-type continuous miner incorporating a gathering head embodying the present invention.
Figure 2:
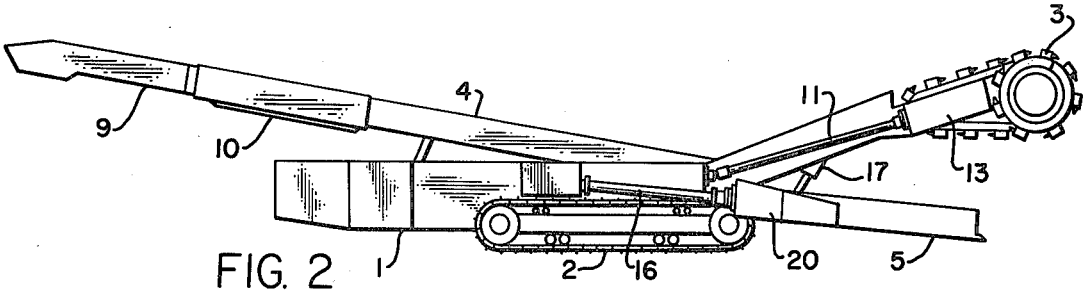
FIG. 2 is a side elevation of the miner shown in FIG. 1.
Figure 3:
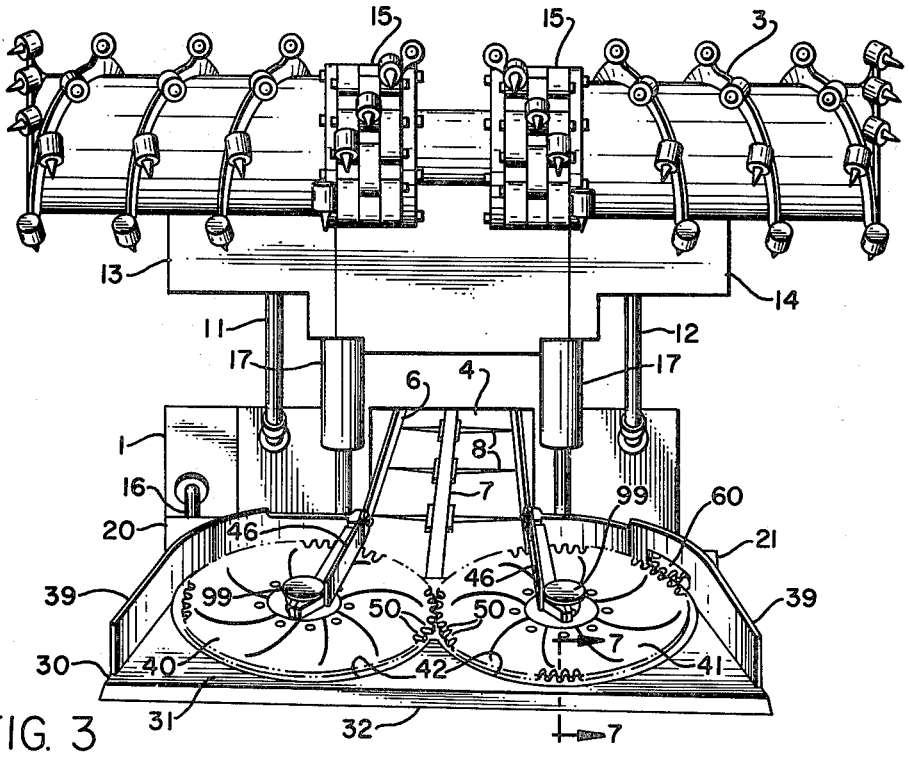
FIG. 3 is a front elevation view of a typical miner such as shown in FIGS. 1 and 2, and incorporating a gathering head embodying the present invention.

Referring to FIGS. 1, 2, and 3, the continuous mining machine has a mobile frame 1 mounted for tramming toward and sumping into the mine face on crawler treads 2. A drum-type cutting head or auger 3 is supported on an axis parallel to the mine face on support arms pivotably attached to and extending forwardly from the front of the frame 1. A gathering head 5 is also pivotably supported from the front of frame 1 and disposed below the auger 3.

A conveyor 4 extends generally along the centerline of the frame from the rear of the gathering head to beyond the rear of the machine. The conveyor comprises a trough 6 with side flanges and a chain 7 with transverse scraper bars 8. For convenience the rear of the conveyor 4 includes a swingtail section 9 which is pivotable about joint 10.

Various electric motors and gear reduction units for driving the crawler units, the auger, the gathering head, and the conveyor are also mounted on the frame 1. The crawler units 2 are connected directly to their drive units. However, power for the auger 3 is transmitted from sources on the frame through universal shafts 11 and 12 to the auger gear cases 13 and 14, respectively. The right and left hand gear cases are mounted on the auger support arms and are synchronized through internal means not shown. The gear cases 13 and 14 rotate the auger 3 through gearing enclosed in the support arms. Trim chains 15, fitted with cutting bits, are driven by sprockets on the auger 3 and cut clearance for the support arms.

Power for the gathering head 5 and conveyor 4 is transmitted by a universal shaft 16 to gear case 20 and then through a cross shaft 27 described later.

In operation, the mining machine is trammed forward and sumped into the mine face on the crawlers 2. The rotating auger 3 cuts material from the face which falls onto or in front of the gathering head 5. The gathering head feeds the material back onto the conveyor 4 which in turn carries it to the rear of the machine to a haulage vehicle or other device for removing it from the mine.

The cutting head or auger 3 can be pivoted up and down the coal seam such as by hydraulic cylinders 17. Similarly, smaller cylinders, not shown here, can be used to provide for vertical adjustment of the gathering head 5 where uneven floor conditions or other considerations require it.

Referring now to FIGS. 4–7, the gathering head 5 will be discussed in greater detail. It has a structural base 30 with an inclined upper surface or apron 31 which slopes down to a plow-like leading edge 32. A trough 33 extends from the back of base 30 and terminates with opposed flanges 34 and 35 which have coaxial holes 36 and 37, respectively. The gathering head 5 is pivotably connected to the frame 1 on a pivot axle which extends through the holes 36 and 37. With this arrangement, the trough 33 forms a forward extension of conveyor trough 6.

Clevises 38 attached to the back of base 30 connect to fluid cylinders, not shown, which in turn are connected to the frame 1 to form the means for pivotably adjusting the gathering head. An upstanding rail or guard 39 extends along the back and side edges of the apron 31 and serves to keep the mined material from spilling over the sides. Also mounted on the base 30 are gear box housings 20 and 21.

Large circular gathering discs 40 and 41 are mounted on the apron 31 in recesses 42 such that the top of the discs are generally flush with the apron. The discs are disposed for counter rotation, as shown by the arrows, on opposite sides of the centerline of the machine and operate to move the mined material toward the center and rear of the apron 31 and onto the trough 33. Upstanding vanes 45 are spaced radially on the surface of the gathering disc to assist in conveying the mined material. Fences 46 are disposed with some clearance above the gathering discs and extend from the center of each disc to the throat of the trough 33. As the discs 40 and 41 rotate, the fences 46 scrape the material off the disc and funnel it onto the conveyor 4.

Rotating disc-type gathering heads, such as described so far, have been known and used before. But, unlike the spaced apart and independently driven discs of these prior art devices, the gathering discs 40 and 41 positively engage each other at their common tangent such that one disc rotates the other. It was initially thought that such an arrangement would be illadvised because mined material would get into the area of contact between the discs and jam the works or otherwise create maintenance problems. On the contrary, however, actual demonstration has shown that the arrangement not only works without the anticipated problems, but that it offers several advantages over the prior devices.

For example, since one disc drives the other their synchronization is assured and the drive train for the head can be simplified. Further by driving the first disc at its periphery the need for means located beneath the apron to rotate the disc by its shaft is eliminated. Now the drive train can be moved to the back or thicker part of the gathering head base and the overall profile of the gathering head reduced. This not only makes the head load more easily, but increases the clearance below the cutting head so that interference with the trim chains or other auger components is eliminated or reduced.

In the gathering head shown in the drawings, the discs 40 and 41 are provided with gear teeth 50 evenly spaced around their periphery. Positive engagement between the discs is effected by the intermeshing of their respective gear teeth as they rotate past the center of the apron 31. The gear teeth 50 can be specially designed to suit the circumstances, but teeth of a standard profile and with a pitch in the range of one inch have proven quite workable. Although it would not necessarily be so in all cases, the discs 40 and 41, as shown here, are identical in size and have the same number of gear teeth.

A simple pinion gear 60, placed in engagement with the periphery of gathering disc 41 at a location high on the apron 31, rotatably drives disc 41 which in turn rotates disc 40 in the opposite direction. The pinion gear 60 is preferably disposed slightly above or flush with the apron 31 and mostly outside the rail 39 such that only a small portion of the pinion 60 is exposed to the mined material.

Figure 5:
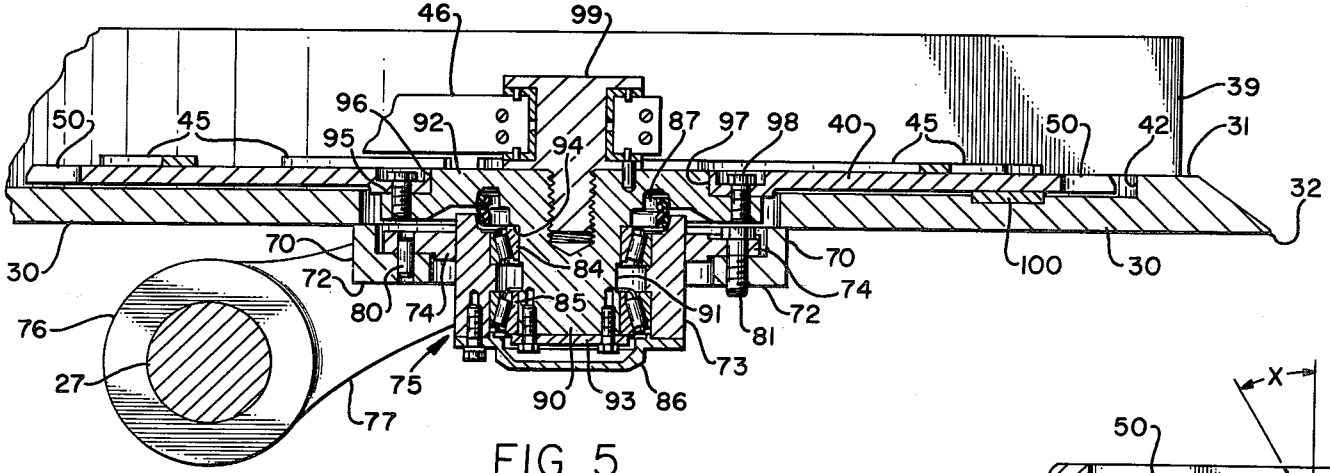
FIG. 5 is a cross-sectional view showing in elevation one of the gathering discs and its means of support in the apron of the gathering head, and is taken along the lines 5—5 in FIG. 4.

Since the gathering discs are not rotated by their axles or shafts as in prior disc-type heads, the support assembly for the discs can be simplified as shown in FIG. 5. An annular ring 70 is attached to the apron 31 below and concentric with the circular opening 71 in the apron. The ring 70 has an inwardly extending flange 72 provided with radially spaced holes.

A specially designed machine member 75, to be further described later, includes a cylindrical housing 73 with an outwardly extending annular flange 74. Flange 74 has holes which match with those in flange 72 and is fastened to the ring 70 by bolts 81. One or more dowels 80 can be used to facilitate alignment of the holes during assembly. The cylindrical housing 73 is internally machined to accommodate upper and lower bearings 84 and 85; the latter being held in place by retaining plate 86.

A stub shaft, indicated generally at 90, is provided for each gathering disc. The stub shaft includes a cylindrical body 91 adapted to fit in the bearings 84 and 85. The shoulder 94 seats against upper bearing 84 and the shaft 90 is held in place by the retainer 93 which is bolted to the bottom of the cylindrical body 91 and bears against lower bearing 85. A seal 87 protects the bearing area from contamination and loss of lubricant.

The stub shaft 90 also includes an outwardly extending annular flange 92 which has a series of holes on a recessed, peripheral bolt circle 95. The gathering disc 40 has a central circular opening 97 of generally the same diameter as the shoulder 96 of the stub shaft 90. The opening 97 is surrounded by a plurality of bolt holes which match up with those on flange 92. The disc 40 is fastened to the stub shaft with bolts 98, the heads of which are recessed flush with the disc surface.

A hub 99 is threadably fastened to the stub shaft 90 and supports one end of the fence 46. The other end of the fence 46 is connected to one side of the conveyor trough 33. Although the hub 99 rotates, the fence 46 remains stationary.

Supported in the manner shown, the disc 40 can rotate freely about its axis with some clearance above the recessed surface 42 of apron 31. However, the disc 40 may be subject to greater loading in certain areas, such as near the center of the gathering head, and may be caused to deflect in those areas. Therefore, it has been found advantageous to place small wear pads 100 in the recessed surface 42 in certain locations under the disc 40 where it may deflect.

With the support arrangement just described, maintenance of the gathering head is simplified. The gathering discs 40 and 41, which are the parts most likely to wear fast, can be taken off by first removing the fence 46 and then simply removing the bolts 98. To gain access to the stub shaft 90 and the bearings, it is further necessary to remove retainers 86 and 93.

Figure 4:
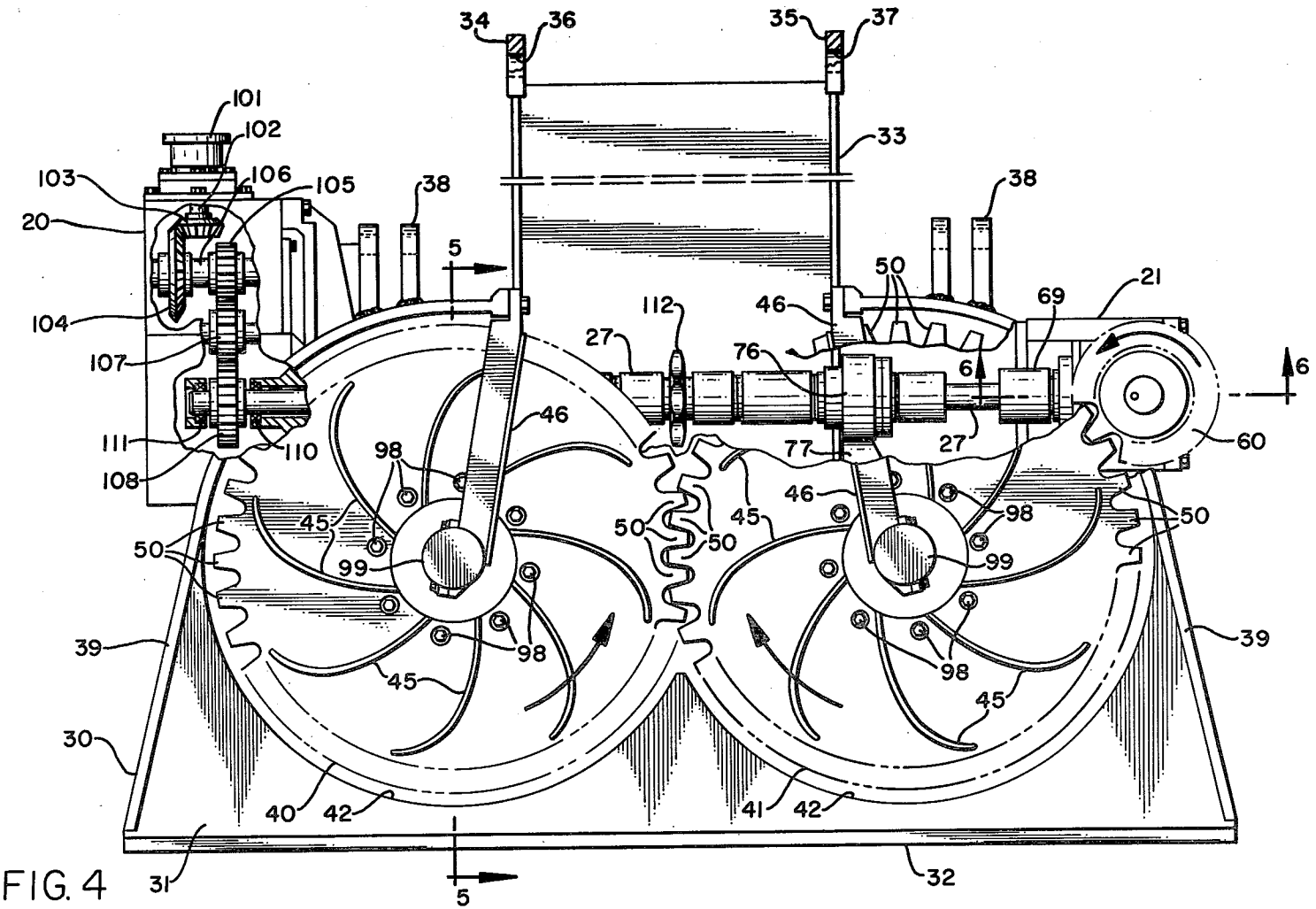
FIG. 4 is a plan view, partly in section, showing a gathering head embodying the present invention.

As mentioned previously, the drive for this gathering head is simpler and more conveniently located than that of the prior gathering heads. Referring to FIG. 4, rotary power transmitted by the universal shaft 16 is received by coupling 101 and transmitted through shaft 102 to bevel gear 103 located in gear case 20. Gear 103 drives another bevel gear 104 which is mounted at right angle to gear 103 on shaft 106. Spur gear 105 also mounted on shaft 106, rotates intermediate spur gear 107 and, in turn, spur gear 108 which is mounted to the cross shaft 27.

Referring briefly to FIG. 5, the machine member 75 also includes an outrigger support arm 77 with a horizontal bearing sleeve 76 at its outboard end. The cross shaft 27 is supported at one end by the bearings 110 and 111, at intermediate points by bearing sleeve 76 of the machine members 75 which are bolted to the base 30, and at the other end by bearings 62 and 63 shown in FIG. 6.

Cross shaft 27 drives the conveyor 4 by means of sprocket 112 located centrally on shaft 27 and which engages the chain 7. Cross shaft 27 also drives the gathering discs 40 and 41 as can best be seen in FIG. 6. Shaft 27 is connected by coupling 61 to shaft 64 which is supported in bearings 62 and 63 and on which is mounted bevel gear 65. Gear 65 in turn rotates bevel gear 66 mounted at right angle on shaft 69 which is supported by upper and lower bearings 67 and 68. Shaft 69 rotates pinion gear 60 which in turn drives the gathering discs 41 and 40.

Because the cross shaft 27 does not have to engage means on the shaft of the gathering discs it can be located near the back of the gathering head. This allows the profile of the gathering head to be minimized with the advantages aforementioned.

The width of the gathering head 5 is generally determined by the width of the cutting head 3. Typically the sides of the base 30 flare slightly so that the width at the leading edge is only slightly less than the width of the auger 3.

The size of the gathering discs 40 and 41 are largely determined by the width of the gathering head. For instance, on a nominal 8 foot wide machine, discs of a nominal 4 feet in diameter are appropriate. However, there may be some cases, such as with the extensible augers presently known in the art, where a gathering head of greater width, but not greater depth, is needed. In some cases, this feature has been provided for by the use of pivotable wings incorporated as part of the apron 31 and guard rails 39. These adjustable wings are connected to the base at a point back along the side of the head and can be pivoted outward to enlarge the throat area of the gathering head.

Figure 8:
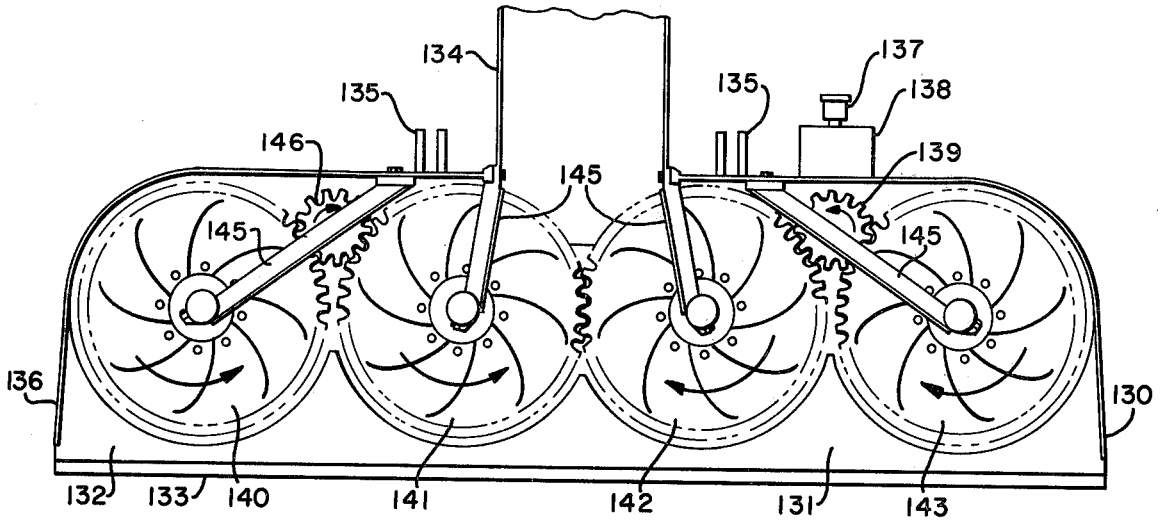
FIG. 8 is a plan view of another gathering head showing another embodiment of the subject invention.

However, the present invention makes feasible another type of wide gathering head. Such a head is shown in FIG. 8 and includes four large gathering discs 140, 141, 142, and 143. Because of the external drive feature, manifest in the form of peripheral gear teeth on the discs, it is possible to have such a multiple disc head without a complicated drive arrangement.

The gathering head in FIG. 8 includes a base 130 with an inclined apron 131, a plow like leading edge 132, and a perimeter rail 136 to prevent spillage. A conveyor trough 134 and mounting clevises 135 extend from the back of the base 130 in the manner described earlier. Each of the rotating discs are provided with upstanding vanes, and fences 146 extend from the center of each disc to a point at the back of the gathering head.

Power for driving the gathering head is received via a universal shaft by coupling 137 on gear box 138. Through a gear arrangement similar to that of FIG. 6, the power is transmitted to and rotates the pinion gear 139. Pinion gear 139 engages and rotates disc 142. As in the gathering head 5 of FIG. 4, the two center discs 141 and 142 engage at the center of the head and disc 141 is rotated in the counter direction by disc 142. In order to get the correct direction of rotation, an intermediate gear 146 engages both discs 141 and 140 to drive the latter. Disc 143 is also driven by pinion gear 139.

The gathering head of FIG. 8 is one example of a multiple disc gathering head made more practical by the use of peripherally driven discs, and will suggest a variety of other arrangements depending on the configuration of the gathering head and the patterns of flow desired.

Figure 7:
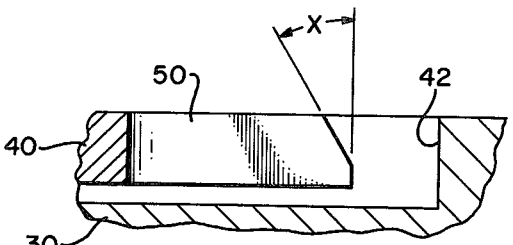
FIG. 7 is an enlarged sectional view in elevation showing the profile of the edge of one of the gathering discs, and is taken along the line 7—7 in FIG. 3.
Figure 6:
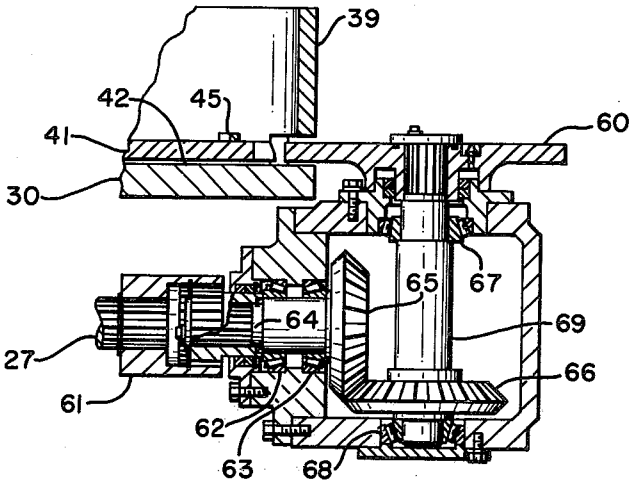
FIG. 6 is a cross-sectional view showing in elevation the pinion gear and its means of support in the apron, and is taken along the lines 6—6 in FIG. 4.

Referring to FIG. 7, one additional aspect of the invention bears mentioning. Although, as stated previously, it has been demonstrated that a gathering head such as that described above and having discs with peripheral gear teeth will convey material such as mined coal without the material jamming the meshing area of the gear teeth, it has been found advantageous to alter the tooth shape some to improve the self cleaning action of the gears. As mentioned, the profile of the gear teeth 50 is generally that of a standard gear tooth. As such the contact point or load point is at the pitch circle of the gear. To remove material from either the leading or trailing edge of the tooth would possibly weaken the tooth. However, by machining a bevel on the outer periphery of the tooth 50, as indicated by the angle X, it has been shown that material caught between meshing teeth is either readily ejected therefrom or more readily crushed therebetween. In addition to the fact that such a bevel does not weaken the tooth in the contact area, it is easily machined.

The embodiments of the invention in which an exclusive property or privilege is claimed are defined as follows:

1. An improved gathering or loading device for moving loose material, such as mined coal or the like, to other means associated with the device, such as a conveyor, wherein the device comprises:

a base having an inclined apron extending from the back of the device downwardly to a plow-like leading edge;

at least two large circular discs mounted for rotation on the base in a common plane generally flush with the apron and in positive engagement with each other at their point of tangency; and drive means for rotating a first of the discs whereupon the first disc turns the second disc in the counter rotational direction, the arrangement and rotational directions of the discs being such as to move the loose material from front to back of the base and to the associated means.

2. A gathering device as recited in claim 1, wherein each of the discs has a plurality of gear teeth evenly spaced about its periphery which upon rotation mesh with the gear teeth on the other disc.

3. A gathering device as recited in claim 2, wherein the discs are identical in size and have the same number of gear teeth.

4. A gathering device as recited in claim 1, wherein the means for rotating the first disc is mounted above the apron and engages the periphery of the disc.

5. A gathering device as recited in claim 2, wherein the means for rotating the first disc comprises a pinion gear mounted on the base adjacent the periphery of the first disc.

6. A gathering device as recited in claim 2, wherein the gear teeth on the discs are outwardly and downwardly beveled such that loose material falling between the discs is more readily forced out as the discs rotate.

7. A gathering device as recited in claim 5, further including at least one additional circular disc rotatably mounted on the base in the same plane with the first and second discs, the additional disc also having peripheral gear teeth which are engaged by the pinion gear to rotate the additional disc in the same rotational direction as the first disc.

8. A gathering device as recited in claim 5, further including at least one additional circular disc having peripheral gear teeth and mounted for free rotation on the base in the same plane as the first and second circular discs, and an intermediate gear mounted for free rotation on the base in engagement with both the second disc and the additional disc whereby when the second disc rotates the additional disc is rotated in the same direction.

9. A gathering device particularly suited for use with a continuous mining machine to gather the mined material and feed it to means associated with the miner for conveying the material away from the mine face, comprising:

a base adapted at one end for connection to the mining machine adjacent one end of the conveying means and having an inclined apron sloping down and away from the one end to a plow-like leading edge at the other end;

at least two generally flat circular discs mounted for rotation on the base in a common plane generally flush with the apron and on opposite sides of the forwardly projected centerline of the conveyor means, the discs being in positive engagement with each other at their point of tangency; and means mounted on the base for rotating one of the discs whereupon the one disc in turn effects counter rotation of the other disc, the arrangement and rotational direction of the discs being such that mined material on the device is moved toward the center and back of the apron to the conveyor means.

10. A gathering device as recited in claim 9, wherein each of the discs has a plurality of gear teeth evenly spaced about its periphery which upon rotating mesh with the gear teeth of the other disc.

11. A gathering disc as recited in claim 10, wherein the means for rotating the one disc comprises a pinion gear mounted on the base in engagement with the periphery of the one disc.

12. A gathering device as recited in claim 11, wherein the means for rotating the one disc further includes a shaft extending across and beneath the base near the rear thereof, and gear means connecting one end of the shaft to the pinion gear.

13. A gathering device as recited in claim 12, further including means mounted on the base connecting the shaft to a power source mounted on the mining machine.

14. A gathering device as recited in claim 12 further including means on the shaft for also driving the conveyor means.

15. A gathering or loading device for moving loose material, such as mined coal or the like, to other means associated with the device, wherein the device comprises:

a base having a sloping apron surface extending from the back of the device downwardly to a plow-like leading edge;

a plurality of large circular discs rotatably mounted on the base in a common plane generally flush with the apron surface, at least two of the discs being in positive peripheral engagement with each other, a first of the two discs being rotatably driven and in turn driving the second of the two discs in the counter rotational direction, means in peripheral engagement with each of the remaining circular discs to rotate each of the remaining discs in the same direction as the closest of the two discs, the arrangement and rotational direction of the discs being such as to move the loose material toward the two discs and along their adjacent perimeters to the rear of the device.

16. A gathering device as recited in claim 9, wherein each of the discs are mounted in a recess in the base, and further including wear pads mounted in selected positions about the recess below the disc, wherein the pads are normally spaced slightly from the bottom of the disc but are effective to support the outer region of the disc when that region deflects due to eccentric loads imposed on the disc.

* * * * *